US008460570B2

(12) United States Patent
Elliott

(10) Patent No.: US 8,460,570 B2
(45) Date of Patent: Jun. 11, 2013

(54) FLOATING FOAM FOR FIRE FIGHTING

(75) Inventor: Mark Elliott, Dubai (AE)

(73) Assignee: Weatherford/Lamb, Inc., Houston, TX (US)

( * ) Notice: Subject to any disclaimer, the term of this patent is extended or adjusted under 35 U.S.C. 154(b) by 1803 days.

(21) Appl. No.: 11/468,109

(22) Filed: Aug. 29, 2006

(65) Prior Publication Data

US 2007/0209808 A1 Sep. 13, 2007

Related U.S. Application Data

(60) Provisional application No. 60/724,538, filed on Oct. 7, 2005.

(51) Int. Cl.
*A62D 1/00* (2006.01)

(52) U.S. Cl.
USPC ..... 252/2; 169/44; 169/46; 169/64; 252/6.5; 252/8.05

(58) Field of Classification Search
USPC ..... 169/44, 46, 64; 252/2, 6.5, 8.05
See application file for complete search history.

(56) References Cited

U.S. PATENT DOCUMENTS

| | | | | |
|---|---|---|---|---|
| 3,172,477 | A | | 3/1965 | Grisdale et al. |
| 3,272,263 | A | | 9/1966 | Jamison |
| 3,469,405 | A | | 9/1969 | Reinhold |
| 3,500,934 | A | | 3/1970 | Magnuson |
| 3,692,117 | A | | 9/1972 | Wright |
| 4,641,711 | A | | 2/1987 | Terry |
| 5,069,290 | A | * | 12/1991 | Brotz ..... 169/45 |
| 5,464,065 | A | | 11/1995 | Kaylor |
| 5,497,833 | A | | 3/1996 | Kaylor |
| 5,623,995 | A | | 4/1997 | Smagac |
| 5,632,338 | A | | 5/1997 | Hunter |
| 5,683,294 | A | | 11/1997 | Maines |
| 5,799,735 | A | | 9/1998 | Sundholm |
| 5,853,050 | A | | 12/1998 | Kittle |
| 6,112,819 | A | | 9/2000 | Henry |
| 6,155,351 | A | | 12/2000 | Breedlove et al. |
| 6,267,183 | B1 | | 7/2001 | Smagac |
| 7,096,965 | B2 | | 8/2006 | Ozment |

FOREIGN PATENT DOCUMENTS

| | | |
|---|---|---|
| CA | 2601945 | 9/2006 |
| FR | 2676011 | 10/1993 |
| GB | 1021760 | 3/1966 |
| SU | 1600798 | 10/1990 |
| WO | WO 2006/093811 | 9/2006 |

OTHER PUBLICATIONS

GB Search Report, Application No. GB0619112.6, dated Jan. 9, 2007.

(Continued)

*Primary Examiner* — Jason Boeckmann
(74) *Attorney, Agent, or Firm* — Patterson & Sheridan, L.L.P.

(57) ABSTRACT

Foams and methods of using foams for fighting fires in confined areas (i.e., mine shafts) are provided. In one embodiment, a foam for extinguishing a fire is provided. The foam includes a surfactant; a non-flammable liquid; and an inert gas having a density substantially less than air. Preferably, the density of the foam is substantially less than the density of air. The light foam will allow a basic form of directional control of the foam because the light foam will float towards the ceiling of a cavern or mine shaft. This offers fire fighters several options in extinguishing an underground fire.

7 Claims, 1 Drawing Sheet

OTHER PUBLICATIONS

Chemguard Specialty Chemicals & Equipment—"General Foam Information", Data Sheet #D10D03010, Revision: Sep. 2005, 6 pages.

Canadian Office Action, Application No. 2,561,468, dated Apr. 23, 2009.

Great Britain Office Action, Application No. GB0619112.6, dated May 1, 2009.

* cited by examiner

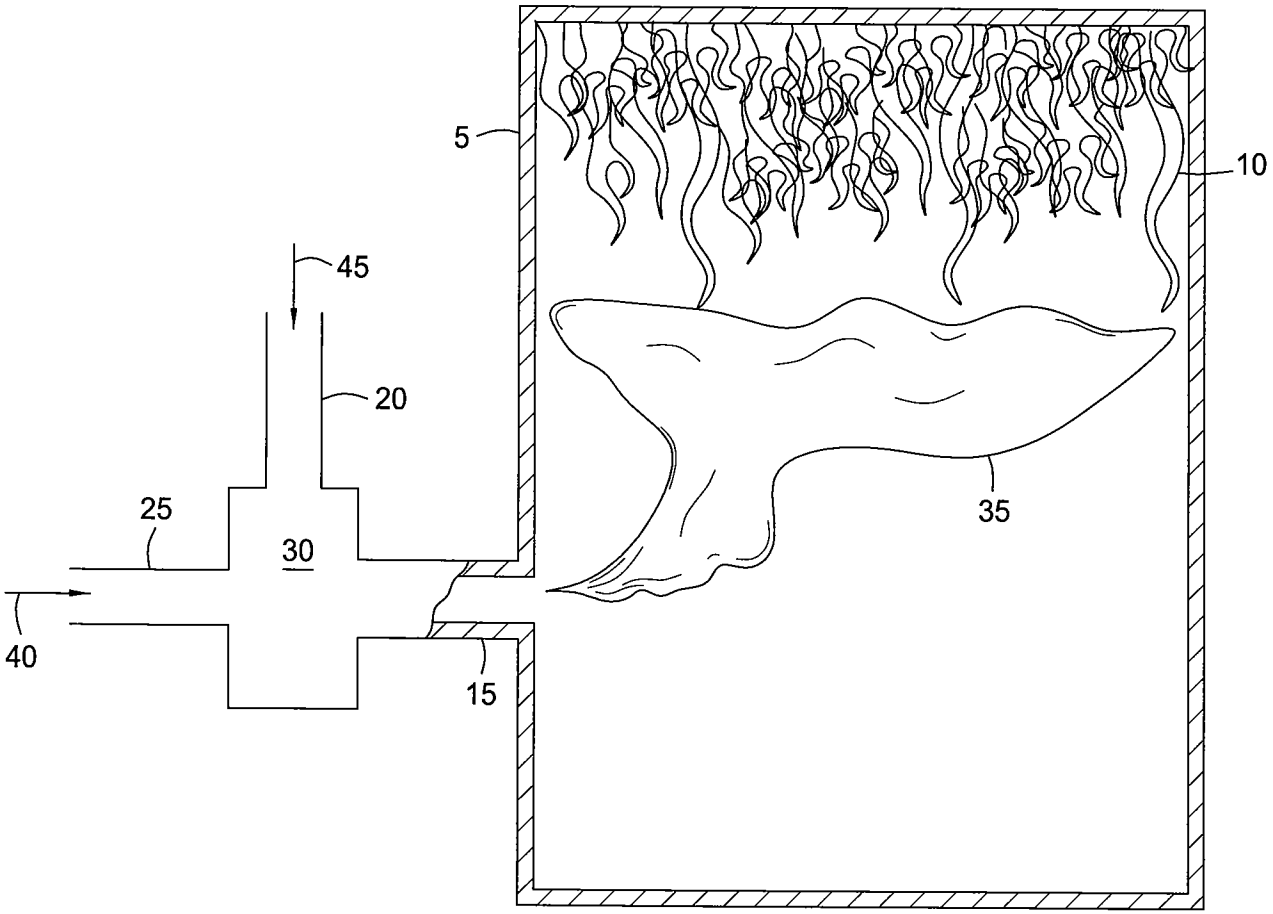
10
5
35
15
45
20
30
25
40

FLOATING FOAM FOR FIRE FIGHTING

CROSS-REFERENCE TO RELATED APPLICATIONS

This application claims the benefit of U.S. Provisional Patent Application No. 60/724,538, filed Oct. 7, 2005, which is hereby incorporated by reference.

U.S. patent application Ser. No. 10/620,882 (Pub. No. 2004/0016552), filed Jul. 16, 2003 and entitled "Method And Apparatus For Fighting Fires In Confined Areas" is herein incorporated by reference.

U.S. Pat. No. 5,683,294, filed Sep. 16, 1996 and entitled "Temporary Brattice for Mines" is herein incorporated by reference.

BACKGROUND OF THE INVENTION

1. Field of the Invention

Embodiments of the present invention generally relate to fire-fighting and more particularly to a foam for fighting fires in confined areas.

2. Description of the Related Art

Fires in confined areas can be extremely difficult to contain much less to extinguish due to a number of factors, for example, heat buildup, the availability of fuel, and the presence of toxic gases. These factors make delivery of fire suppressant material difficult. Hot combustion gases are confined and can be prone to explosion and can provide additional fuel to the fire. In addition, the combustion gases normally contain toxic levels of carbon monoxide gas, methane gas, and other toxic substances.

Examples of confined areas susceptible to fires are storage tanks, underground mines, and landfills. In coal mine fires, the abundance of fuel in a confined, poorly accessible area practically guarantees that the fire will burn for extremely long periods of time with resultant loss of production and great property loss. Many coal mines must be abandoned in the event of a fire because of the great difficulty in extinguishing the fire. For example, the Jonesville coal mine fire started more than 30 years ago and is still burning. The town of Centrala, Pa. has been abandoned because seeping of noxious gases to the surface from a coal mine fire that began in 1961. The residents of the City of Youngstown have seen their property values drop to near zero due to the Percy mine fire in Fayette County, Pa. that has been burning for more than 30 years and they are concerned that they will lose their homes.

Fighting a fire in a mine in general comprises the steps of (i) creating a seal between the portion of the confined area involved in the fire and the uninvolved portion of the confined area; and (ii) introducing a fire suppressant or allowing the fire to burn itself out while maintaining the involved area sealed. Typically, the atmosphere of the involved area is drawn out after it has been sealed. In many cases, however, removing the atmosphere from the involved area is not possible or practical. In addition, the involved area is often flooded with water to attempt to extinguish the fire and generally reduce the temperature at the involved area.

Permanent and temporary seals or brattices are well known and have been long used in the mining field for sealing portions of a passage or shaft in a mine. Brattices of varying designs are used to for ventilation control and for emergencies, such as in the event of a fire. The brattice is fire proof and provides a suitable opening to permit the distribution of fire suppressant to the area involved in the fire. A discussion of several different brattice designs is found in the '294 patent.

In mine fires where the involved area is sealed, it is preferred that the atmosphere in the sealed area is drawn out so as to reduce as much as possible the oxygen in the sealed area to limit or slow the progress of the fire. This may followed by an attempt to flood the area with water. In the fires at Centralia, Percy, and Jonesville mines, described above, these procedures alone did not work with the resultant loss to the community and to the mine operators.

Water is not the most effective fire suppressant or extinguishing material for use in most confined area fires, particularly in fighting coal mine fires. In many cases the water does not reach the fire because of dips and fissures in the mine shaft that in effect pool, retain, or otherwise divert the water and prevent it from reaching the fire. In addition, the contact time of water that does reach the fire is short and the water evaporates and does not thoroughly penetrate and/or wet the fuel supporting the fire.

Conventional foam has been applied in attempting to extinguish coal mine fires. This foam is expanded with air that, of course, contains a substantial concentration of oxygen thus adding a highly combustible substance to the fire that becomes available to support combustion as the foam breaks down.

Other techniques include injecting carbon dioxide and/or nitrogen. Nitrogen can be used either in gaseous form or by being mixed with a surfactant and water to produce high expansion foam. The foam is used to suppress the fire as well as forming a barrier to direct gas flows around the mine. However, since the densities of nitrogen and carbon dioxide are substantially the same or greater than that of air, the injected gas/foam will not affect fires burning in the roofs of caverns unless the entire involved area is flooded with the gas or foam. Such an operation requires heavy equipment and a substantial amount of time. In one instance, a jet engine was used to suppress such a fire by injecting an entire mine with carbon dioxide.

Although not prone to the extremely long burning periods encountered in coal mine fires, other fire locations such as underground fuel storage tanks, above ground chemical storage tanks and the like present similar problems. It is difficult to apply fire suppressant material to the fire because of the danger to the firefighters from explosion, heat buildup and toxic gases.

Therefore, there exists a need in the art for an improved fire suppressant for fighting fires in confined areas.

SUMMARY OF THE INVENTION

In one embodiment, a foam for extinguishing a fire is provided. The foam includes a surfactant; a non-flammable liquid; and an inert gas having a density substantially less than the density of air. In one aspect of the embodiment, the density of the foam is substantially less than the density of air. In another aspect of the embodiment, the non-flammable liquid is water. In another aspect of the embodiment, the inert gas is helium. In another aspect of the embodiment, the inert gas is a mixture of helium and nitrogen. In another aspect of the embodiment, a method for using the foam of the above embodiment is provided. The method includes the acts of producing the foam; and injecting the foam into a confined area to extinguish a fire in the confined area. In one sub-aspect, the confined area is a mine shaft. In another aspect of the embodiment, a method of producing the foam of claim 1 is provided. The method includes the acts of mixing the surfactant and the liquid to form a mixture; and injecting the inert gas into the mixture to form the foam in a proportion so that the density of the foam is substantially less than the density of air.

In another embodiment, a method for extinguishing a fire in a confined area is provided. The method includes the acts of: providing at least one inlet to a portion of the confined area involved in the fire; proportioning a foam concentrate into a non-flammable liquid to form a foam concentrate/liquid mixture; forming a foam fire suppressant by injecting an inert gas, having a density substantially less than the density of air, under pressure to the foam concentrate/liquid mixture to expand the foam concentrate in the non-flammable liquid; and dispensing the expanded foam fire suppressant through the inlet.

In one aspect of the embodiment, the inert gas is injected in a proportion so that the density of the expanded foam is substantially less than the density of air. In another aspect of the embodiment, the inert gas is helium. In another aspect of the embodiment, the inert gas is a mixture of helium and nitrogen. In another aspect of the embodiment, the method further includes the act of flooding the involved portion with water prior to introducing the foam.

In another aspect of the embodiment, the method further includes the act of forming a seal between the involved portion and uninvolved portions of the confined area. In one sub-aspect, the method further includes the act of drawing out at least a portion of the ambient atmosphere from the involved portion after it has been sealed thereby to reduce the amount of oxygen and gaseous fuel available to the fire.

In another aspect of the embodiment, the foam is expanded by a dispenser that proportions the gas into a concentrate/liquid stream thereby to initiate expansion of the foam. In one sub-aspect, the gas is proportioned to the concentrate/liquid mixture in a ratio of about 2 gallons per minute of the liquid/foam concentrate mixture to about 1 cubic foot per minute of the gas. In another sub-aspect, the dispenser directs the expanded foam to the sealed portion involved in fire through the inlet.

In another aspect of the embodiment, the expanded foam is injected into the involved portion thereby to substantially close off contact between combustible material involved in the fire and the ambient atmosphere. In another aspect of the embodiment, the non-flammable liquid is water. In one sub-aspect, the concentration of the foam concentrate in water comprises between about 0.1% to about 1.0%.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 1 is a partial section view of a fire in a confined area being extinguished, according to one embodiment of the present invention.

DETAILED DESCRIPTION

Embodiments of the present invention are applicable to fires in various confined areas, however, for purposes of description the invention will be described in connection with mine fires and more particularly with fires that occur in coal mines. It will be apparent, however, that the principles described in connection with fighting a mine fire are applicable to fires occurring at other confined areas.

FIG. 1 is a partial section view of a fire 10 in a confined area 5 being extinguished, according to one embodiment of the present invention. A high expansion foam concentrate is mixed with water. The water/foam concentrate mixture 40 is expanded with a gas 45, such as helium, a mixture of helium and nitrogen, or a mixture of helium with any other inert gas, such that the overall density of the foam 35 is substantially less than the density of air (hereinafter "light" foam). Alternatively, any inert gas having a density substantially less than that of air may be used to lighten the foam.

A proportioning device may be utilized for mixing the concentrate and the water. The gas 45 may be then injected into the foam concentrate/water mixture 40 under pressure for expanding the foam. A dispensing device may be employed to inject the expanded foam into the area involved in fire.

Commercially available high expansion foam concentrates may be used in producing the fire suppressant foam. Class A foam concentrates are preferred both for their ability to isolate the fuel and because the proportioning of the concentrate and water is not as critical as for Class B foams. Such concentrates consist primarily of a surfactant dissolved in a non-flammable solvent and may further include wetting agents to aid in penetration of the fuel. Typically, the non-flammable solvent is water. The foam concentrate may be proportioned with water in percentages ranging from about 0.1% by volume to about 1% by volume depending on the hardness of the water. In addition, the water may also be used as the primary propellant to distribute the foam.

The choice of proportioning method is not critical. In some cases it may be desirable to premix the foam concentrate and water in a suitable container. Such proportioning method may be preferred in small fires where foam volume will be relatively small. This method also lends itself for use in portable equipment. Venturi type or line proportioning devices are suitable for both portable systems and, for systems requiring a high volume of foam to be produced, are best suited in situations where water pressure is essentially constant in order to insure proper proportioning of water and concentrate and delivery of foam at a constant rate. Other types of proportioners such as "around the pump" proportioners are well suited for delivery of large quantities of foam at a constant rate and as such are highly suited for disbursement of high expansion foam in fighting mine fires.

The helium gas or helium/nitrogen mixture may be proportioned into the water/foam concentrate mixture at a ratio of about 2 gal/min concentrate to 1 cubic foot per minute (cfm) of helium or helium/nitrogen and several hundred cubic feet of foam can be produced from one gallon of the water/concentrate mixture. The flow rate of the water/concentrate mixture and thus the discharge rate of foam is dependent to a large extent on the available supply of helium or helium/nitrogen and water at the site of the fire.

The foam may be expanded and dispensed through a diffuser/dispenser apparatus 30 that functions to introduce pressurized helium or helium/nitrogen into the water/foam concentrate stream to expand the foam and to dispense the expanded foam. One such diffuser/dispenser apparatus for producing nitrogen based foam is disclosed in the '882 Application, however, it may be suitable for use with the light foam according to one embodiment of the present invention.

The diffuser/dispenser apparatus 30 comprises an outer cylindrical casing through the interior of which extends a discharge line 15 parallel with the axis of the outer casing.

The ends of the outer casing are closed around the discharge line. One end of the discharge line extends beyond the outer casing to define an intake 25 that communicates with a source of the water/foam concentrate mixture. The opposite end of the discharge line extends beyond the outer casing at its opposite end to define a discharge 15 for dispensing the highly expanded foam. A helium or helium/nitrogen intake nipple 20 communicates through the outer casing for leading pressurized helium or helium/nitrogen into the outer casing. Alternatively, when, a mixture of helium and nitrogen is used, the diffuser/dispenser may have one nipple for helium and one nipple for nitrogen. A drain nipple (not shown) communicates with the interior of the outer casing for draining fluid from its interior. A portion of the discharge line defines an eductor (not shown) for entraining the helium or helium/nitrogen gas in the water/foam concentrate stream flowing through the discharge line. The eductor is formed by four openings in the wall of the discharge line. Each of the openings is spaced ninety degrees apart from the adjacent openings. A metal screen (not shown) is disposed about the discharge line to overlie the openings.

In operation, water and foam concentrate are mixed as the water flows through a conventional eductor. The water/foam concentrate stream flows into the intake of the diffuser while helium or helium/nitrogen is led into the interior of the outer casing through the nipple that communicates with the helium or helium/nitrogen source. The flow of the liquid stream past the eductor lowers the pressure in the interior of the outer casing that assists in drawing the helium or helium/nitrogen into the flowing stream. The introduction of the helium or helium/nitrogen initiates the full expansion of the foam as it leaves the discharge of the discharge line. The flow of the liquid stream acts to propel the foam from the diffuser. Liquid that passes out of the discharge line through the openings is drained from the interior of the outer casing through the drain nipple.

A diffuser nozzle (not shown) can be affixed to the end of the discharge by suitable means such as by the provision of external threads on the end of the discharge that threadibly engage corresponding internal threads in the diffuser nozzle. The diffuser nozzle can be of any conventional design and although the use of such a nozzle is not required it does serve to enhance the expansion of the foam blanket.

The light foam 35 will allow a basic form of directional control of the foam because the light foam will float towards the ceiling of a cavern or mine shaft. This offers fire fighters several options in extinguishing an underground fire. In the case of the cavern roof fire discussed above, the light foam would have extinguished the fire without the need of a jet engine to flood the entire mine with carbon dioxide. Instead, the fire could have been easily extinguished by injecting only an amount of foam necessary to occupy the cavern roof volume. The light foam will also allow a slug of foam to be positioned in a mine shaft to displace any methane prior to a carbon dioxide sweep of the entire mine. Further, in many instances, the only available injection point to a burning mine shaft is to drill a relief well to the bottom of the shaft. These instances create analogous situations to the cavern roof fire, especially when the fire is not proximate to the bottom of the shaft, since the conventional foam/carbon dioxide would have to be injected until the level reached that of the fire.

While the foregoing is directed to embodiments of the present invention, other and further embodiments of the invention may be devised without departing from the basic scope thereof, and the scope thereof is determined by the claims that follow.

The invention claimed is:

1. A foam for extinguishing a fire, consisting essentially of:
- a surfactant;
- a non-flammable liquid; and
- an inert gas having a density substantially less than the density of air,
- wherein a density of the foam is substantially less than the density of air.

2. The foam of claim 1, wherein the non-flammable liquid is water.

3. The foam of claim 1, wherein the inert gas is helium.

4. The foam of claim 1, wherein the inert gas is a mixture of helium and nitrogen.

5. A method of using the foam of claim 1, comprising the acts of:
- producing the foam of claim 1; and
- injecting the foam of claim 1 into a confined area to extinguish a fire in the confined area.

6. The method of claim 5, wherein the confined area is a mine shaft.

7. A method of producing the foam of claim 1, comprising the acts of:
- mixing the surfactant and the liquid to form a mixture; and
- injecting the inert gas into the mixture to form the foam in a proportion so that the density of the foam is substantially less than the density of air.

* * * * *